United States Patent [19]

Takizawa et al.

[11] 4,253,434

[45] Mar. 3, 1981

[54] VARIABLE VALVE EVENT ENGINE

[75] Inventors: Masaaki Takizawa, Mishima; Noboru Matsubara, Susono, both of Japan

[73] Assignee: Toyota Jidosha Kogyo Kabushiki Kaisha, Toyota, Japan

[21] Appl. No.: 917,242

[22] Filed: Jun. 20, 1978

[30] Foreign Application Priority Data

Apr. 21, 1978 [JP] Japan ..... 53/46702

[51] Int. Cl.[3] ..... F01L 1/34

[52] U.S. Cl. ..... 123/90.15; 123/90.16; 123/90.39; 123/90.6; 74/559; 251/251

[58] Field of Search ..... 123/90.15, 90.16, 90.17, 123/90.18, 90.39, 90.6; 74/559; 251/251

[56] References Cited

U.S. PATENT DOCUMENTS

| | | | |
|---|---|---|---|
| 983,150 | 1/1911 | Leoni | 123/90.18 |
| 1,614,861 | 1/1927 | Bartlett | 123/90.16 |
| 1,688,164 | 10/1928 | Tarrant | 123/90.17 |
| 2,197,282 | 4/1940 | Walker | 123/90.16 |
| 2,397,511 | 4/1946 | Schreck | 123/90.16 |
| 2,678,641 | 5/1954 | Ryder | 123/90.16 |
| 2,934,052 | 4/1960 | Longenecker | 123/90.16 |
| 3,273,546 | 9/1966 | Von Arx | 123/90.15 |
| 3,878,822 | 4/1975 | Beal | 123/90.15 |

FOREIGN PATENT DOCUMENTS

| | | | |
|---|---|---|---|
| 1817169 | 7/1970 | Fed. Rep. of Germany | 123/90.16 |

*Primary Examiner*—Charles J. Myhre
*Assistant Examiner*—W. Wolfe
*Attorney, Agent, or Firm*—Finnegan, Henderson, Farabow, Garrett & Dunner

[57] ABSTRACT

A variable valve event engine has a plurality of cams with different cam profiles and can vary the operating characteristics of the valve by moving a rocker arm for selectively changing the cams in accordance with changes in the operating conditions of the engine. The engine further includes a spring urging member which causes a certain amount of energy to be retained in a spring for rapidly changing the cams. In addition, the engine has a stopper guide positioned between two adjacent cams so that the changing of the cams can be effected while the crankshaft angle of the engine is within a predetermined range.

13 Claims, 7 Drawing Figures

VARIABLE VALVE EVENT ENGINE

BRIEF DESCRIPTION OF THE INVENTION

The present invention relates to a variable valve event engine which can vary the operating characteristics of a valve installed in an internal combustion engine, such as an intake valve or an exhaust valve, in accordance with changes in the operating conditions of the engine.

Generally, the operating characteristics of a conventional engine are influenced by the operating characteristics of the cams which actuate the valves of the engine. For example, if the shape of the cams is selected so as to produce a high torque when the engine including the cams rotates at a low speed, the engine cannot produce a sufficiently high torque at a high rotating speed. On the other hand, if the shape of the cams is selected so that an engine having the cams can produce a high torque at a high rotating speed, the output of the engine is decreased when the engine speed is low. As a result, a conventional engine cannot always produce a high torque for various rotating speeds of the engine.

SUMMARY OF THE INVENTION

An object of the present invention is to provide a variable valve event engine which can easily vary the operating characteristics of a valve so that the variable valve engine can produce a desired high torque for various rotating speeds of the engine.

The above-mentioned object of the present invention is achieved by a variable valve event engine comprising: a rocker shaft disposed along the engine; a rocker arm for actuating a valve of the engine, which arm is pivoted swingably around and slidably along the rocker shaft; a camshaft arranged parallel to the rocker shaft and synchronized with a crankshaft of the engine; and a plurality of adjacent cams fixed in such an arrangement on the camshaft so as to have profiles different from each other, wherein by sliding the rocker arm along the rocker shaft, the valve is selectively actuated by means of one of the cams.

According to the present invention, a cam to be used during a low speed and a cam to be used during a high speed, both having differing cam profiles, are disposed and selectively utilized in accordance with the operating conditions of the engine which has the cams installed thereon.

A criterion for determining the alternation of the cams will now be explained. Two diagrams (not shown), one showing the operating characteristics of engines with cams for high speeds and the other showing the operating characteristics of engines with cams for low speeds, were prepared with values corresponding to the engine operating characteristics being plotted on the ordinate of each graph while the values corresponding to the engine rotating speeds are plotted on the abscissa thereof. The abscissa is partitioned into two regions, a high speed region and a low speed region, the boundary between the regions is formed by a vertical line defined by the intersection of the above-mentioned two diagrams. During low speed conditions, the cam for low speed use is adopted, while during high speed conditions, the cam for high speed use is adopted.

According to the present invention, the cams for low speed and high speed uses can be selectively utilized in accordance with changes in the engine rotating speed, with regard to whether the engine rotating speed is high or low. As a result, the operating torque characteristic of the engine is highly improved if compared with that of a conventional engine which has a single type of cam installed thereon. In addition, the variable valve event engine, according to the present invention, can generate uniform torque characteristics for various engine rotating speeds. The uniform torque obtained by the engine of the present invention can be almost the same as the maximum torque obtained by the conventional engine with a single type cam.

The valve timing (including the valve lift) of the intake and exhaust valves mounted on an engine is adjusted in accordance with changes in the operating conditions of the engine, in other words, with changes in the driving conditions of a vehicle on which the engine is mounted. Such adjustment can be effected by means of the present invention for maintaining a high engine efficiency and for improving the output characteristics and the fuel consumption of the engine during both low and high speed conditions.

Some embodiments of the present invention will be explained hereinafter with reference to the accompanying drawings.

BRIEF DESCRIPTION OF THE DRAWINGS

With reference to FIG. 1 which is a cross-sectional elevational view of a first embodiment of the present invention, mounted and secured onto a cylinder block 1 with a cylinder bore 1*a* formed therein is a cylinder head 3 with a combustion chamber wall 3*a* formed thereon. A piston 5 is slidably and sealingly disposed within the cylinder bore 1*a* so that the space surrounded by the cylinder bore 1*a*, the combustion chamber wall 3*a* and the upper surface of the piston 5 forms a combustion chamber 7. An intake port 9, which is formed in the cylinder head 3 and communicated with an intake manifold (not shown), and an exhaust port (not shown), which is also formed in the cylinder head 3 and communicated with an exhaust manifold (not shown), are both communicated with the combustion chamber 7 via an intake valve 11, which controls the intake of a gas mixture into the combustion chamber 7, and via an exhaust valve (not shown), which controls the flow of exhaust gas from the combustion chamber 7.

Figure 1:
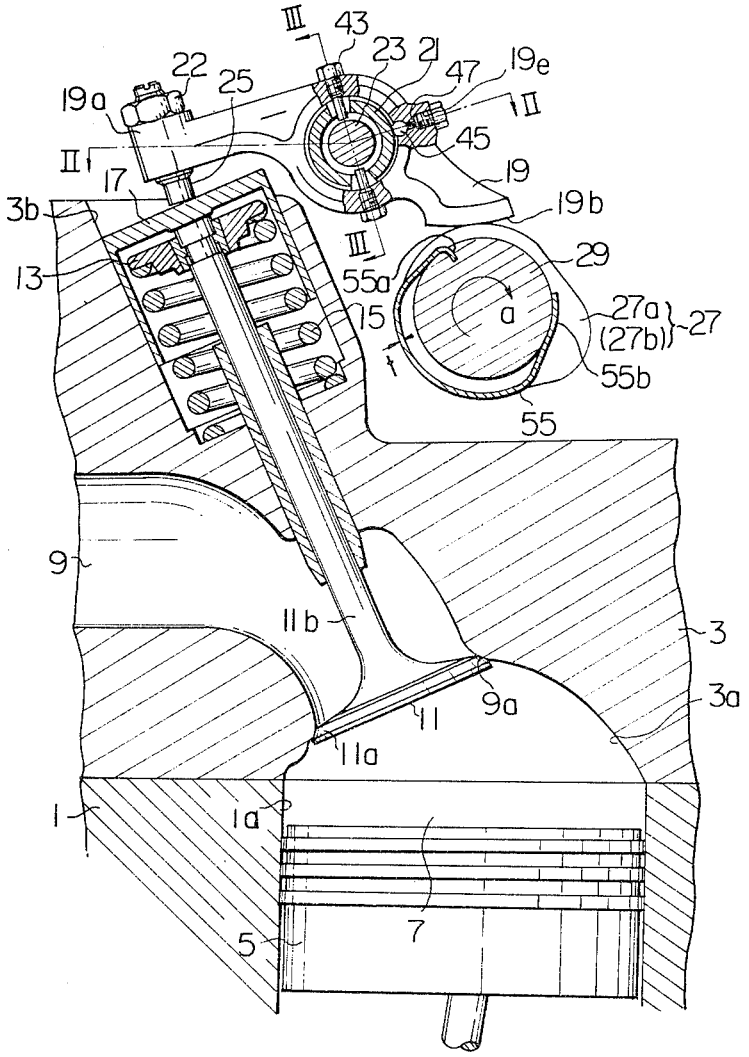
FIG. 1 is a cross-sectional elevational view of a first embodiment according to the present invention.

Since the constructions of the intake valve 11 and the exhaust valve are similar to each other, only the construction of the intake valve 11 will now be described. The intake valve 11 comprises a valve body 11*a*, which cooperates with a valve seat 9*a* formed at the opening portion of the intake port 9 of the combustion chamber 7 for controlling the intake of the gas mixture, and a valve rod 11*b* which is fixed to the valve body 11*a*. The valve rod 11*b* is slidably and sealingly inserted into the cylinder head 3 and has a spring retainer 13 fixed on its rear portion which projects from the cylinder head 3. A compression spring 15 is mounted between the spring retainer 13 and the upper surface of the cylinder head 3 for urging the intake valve 11 upwardly so that the valve body 11*a* can abut against the valve seat 9*a*. Mounted on the valve rod 11*b* of the intake valve 11 is a cylindrical-shaped valve lifter 17 which is slidable within a cylindrical recess 3*b* formed in the cylinder head 3. When the upper surface of the valve lifter 17 is pushed downwardly, the intake valve 11 is opened. A rocker arm 19 adapted to be swingable around a rocker shaft 21 has a knocker 25 which is threadedly secured with a lock nut 22 to one end thereof so that the length of the knocker 25 is adjustable. A cam member 27 is in abutment with a rocker arm pad 19*b* formed at the other end of the rocker arm 19 so that, when the cam 27 is rotated in the direction designated by the arrow a in FIG. 1, the knocker 25 pushes the valve lifter 17 downwardly for opening the intake valve 11.

Figure 2:
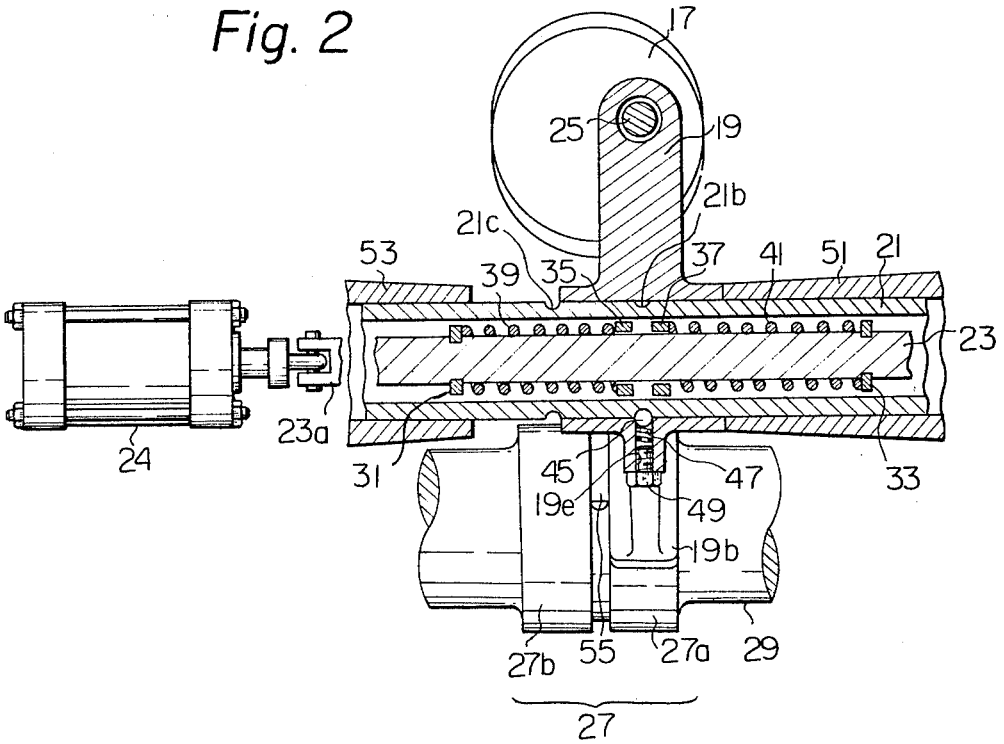
FIG. 2 is a cross-sectional view taken along the line II—II in FIG. 1.

As illustrated in FIG. 2, the cam member 27 includes two adjacent cams 27*a* and 27*b* which are fixed on a camshaft 29 disposed parallel to the rocker shaft 21. The cam profiles of the cams 27*a* and 27*b* are different from each other with respect to their valve lifts and/or valve timings, for example, the cam 27*a* has a cam profile preferable for use during a low speed condition and the cam 27*b* has a cam profile preferable for use during a high speed condition. It should be noted that the number of cams is not limited to two but may be three or more according to preference, and that the base circular portions of the cams 27*a* and 27*b* have substantially the same radii. The camshaft 29 is synchronized with the crankshaft of the engine (not shown) and rotated in a direction designated by the arrow a (FIG. 1).

Figure 3:
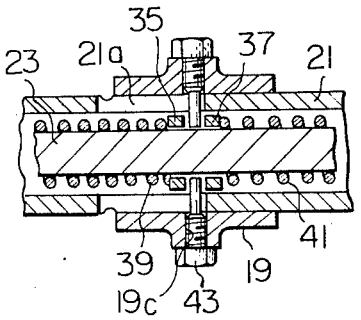
FIG. 3 is a cross-sectional view taken along the line III—III in FIG. 1.

As mentioned above, the rocker arm 19 is not only swingably pivoted to the rocker shaft 21 but also adapted to be slidable along the rocker shaft 21 so that the rocker arm 19 can selectively transmit the movement of each of the cams 27*a* or 27*b* to the valve lifter 17. The slide mechanism of the rocker arm 19 will now be explained with reference to FIGS. 1 through 3. The rocker shaft 21 is made of a hollow cylinder and the rocker arm 19 is swingably and slidably inserted onto the outside wall of the hollow cylinder. A rocker arm slide shaft 23 is disposed inside the hollow cylinder with a certain clearance therebetween and extends along the rocker shaft 21. One end 23*a* of the rocker arm slide shaft 23 is connected to a linear movement mechanism, such as a hydraulic cylinder 24 (illustrated in FIG. 2), a pneumatic cylinder or a mechanism comprising a cam and a driving motor, for moving the rocker arm slide shaft 23 along the rocker shaft 21. The rocker arm slide shaft 23 has two annular-shaped stops 31 and 33 fixed thereon with a certain distance therebetween along the lengthwise direction of the slide shaft 23. Two movable stops 35 and 37 are slidably mounted between the stops 31 and 33 on the rocker arm slide shaft 23 with a small distance therebetween. Connecting compression springs 39 and 41 are installed between the stops 31 and 35, and 33 and 37, respectively. According to the above-mentioned construction, stops 35 and 37 are located at predetermined positions which are determined by the biasing forces generated by the compression springs 39 and 41. As illustrated in FIG. 3, the rocker shaft 21 has a slot 21*a* formed thereon through which a bolt 43 threaded to the rocker arm 19 extends to a space located between the stop 35 and 37, so that the rocker arm 19 is adapted to be movable with the stops 35 and 37. In the first embodiment which is illustrated in the accompanying FIG. 2, the rocker shaft 21 has two annular grooves 21*b* and 21*c* formed therearound at positions which correspond to the cams 27*a* and 27*b*. The rocker arm 19 has a small hole 19*e* formed therein. A ball 45 which is capable of being selectively engaged with the annular groove 21*b* or 21*c* is retained in the hole 19*e* and then urged by a spring 47 so that the rocker arm 19 is in position. A screw bolt 49 is used for retaining the spring 47.

When the rocker arm slide shaft 23 is moved to the left from the position illustrated in FIG. 2 by means of the hydraulic cylinder 24, the contacting compression spring 41 is compressed by the stop 33 so that the stop 37 is urged to the left. However, since the ball 45 is engaged with the annular groove 21*b* formed around the rocker shaft 21, the stop 37 cannot be moved for a while. On the other hand, as the contacting compression spring 41 is compressed, potential energy is retained in the compression spring 41. When the retained potential energy becomes more than a predetermined value, due to the urging force generated by the compression spring 41, the ball 45 is disengaged from the annular groove 21*b*. The rocker arm 19 is next moved within a short period to a position corresponding to the other cam 27*b* by means of the potential energy retained in the compression spring 41 and then positioned there by engaging the ball with the other annular groove 21*c*. The strength of the connecting compression spring 41 is so adjusted that the rocker arm 19 can be moved a certain distance between the cams 27*a* and 27*b*, i.e., the distance between the annular grooves 21*b* and 21*c*. Similarly the rocker arm 19 is moved to the right as seen in FIG. 2, by means of the connecting compression spring 39 when the rocker arm slide shaft 23 is moved to the right. The strength of the compression spring 39 is likewise adjusted so that the rocker arm 19 can be moved a certain distance between the cams 27*a* and 27*b*. The amount of movement of the rocker arm 19 can be limited by covers 51 and 53 which are inserted on the rocker shaft 21 as illustrated in FIG. 2, in addition to the ball 45 and the annular grooves 21*b* and 21*c* which are also used for limiting the movement of the rocker arm 19.

It is preferable that the above-mentioned movement of the rocker arm 19 be effected while the rocker arm pad 19*b* (FIG. 1) is in abutment with a base circular portion of one of the adjacent cams 27*a* and 27*b*. If movement of the rocker arm 19 is not effected under such condition, the rocker arm 19 and/or cams 27*a* and 27*b* may be abraded or damaged when the rocker arm 19 is being moved. This is because the cams 27*a* and 27*b* have different cam profiles with respect to the valve lifts and/or valve timings. As a result, the smooth operation of the engine is disturbed.

In this embodiment, a stopper guide 55 is disposed between the two adjacent cams 27*a* and 27*b* (FIG. 2) to permit the rocker arm 19, to move only when the rocker arm is in abutment with one of the base circular portions of the cams 27*a* and 27*b*. Referring to FIG. 1 again, one end 55*a* of the stopper guide 55 is fixed, at an intermediate portion in the base circles of the cams 27*a* and 27*b*, to the camshaft 29 and the other end 55*b* of the stopper guide 55 is partially wrapped around the camshaft 29 at a trailing portion with respect to the rotational direction of the camshaft 29. The intermediate portion of the stopper guide 55 for connecting both the ends 55*a* and 55*b* is formed in a circular arch shape, and the outside periphery of the intermediate portion of the stopper guide bulges out from the base circles of the cams 27*a* and 27*b* by a certain amount "t", for example, 1 mm. The stopper guide 55 made of a spring steel strip is so constructed and arranged that the stopper guide 55 is rigid against a force acting on the side thereof (i.e., in a direction perpendicular to the sheet on which FIG. 1 is illustrated) but flexible against a force acting on the surface thereof (i.e., in a direction parallel to the sheet on which FIG. 1 is illustrated). As a result, when the rocker arm pad 19*b* formed on the rocker arm 19 is in abutment with a base circular portion but free from the stopper guide 55 of one of the cams 27*a* and 27*b*, and when the rocker arm 19 is commenced to move, the rocker arm 19 cannot be prevented from moving by the stopper guide 55 and is thus caused to move by the energy retaining and rapidly moving mechanism. In addition, even if the rocker arm pad 19*b* should run onto the stopper guide 55 while the rocker arm 19 is moving, the movement of the rocker arm 19 still cannot be prevented because the stopper guide may be easily deflected elastically. On the other hand, while the rocker arm pad 19*b* formed on the rocker arm 19 is in abutment with a portion free from the base circular portion, such as a lift portion, of one of the cams 27*a* and 27*b*, the rocker arm 19 is prevented from moving because the urging forces generated by the connecting compression springs 27*a* and 27*b* are so adjusted that the urging forces are smaller than the frictional forces occurring between the cam 27*a* or 27*b* and the rocker arm pad 19*b* while the intake valve 11 is being opened by the cam 27*a* or 27*b*. In addition, while the rocker arm pad 19*b* is in abutment with a rear half portion of the base circle of the cam 27*a* or 27*b*, in other words, a portion where the stopper guide 55 is disposed, the movement of the rocker arm 19 is prevented by the projecting portion of the stopper guide 55. As a result, the movement of the rocker arm 19 is prevented while it is in abutment with a portion free from the base circles of the cam 27*a* or 27*b* so that defects, such as vibrations of the cam, are fully prevented from occurring. In this case, the rocker arm 19 which has been prevented from moving is moved when the rocker arm 19 comes into abutment with the base circular portion of the cam 27*a* or 27*b*.

To facilitate the smooth movement of the rocker arm 19, the width of the rocker arm pad 19*b* measured along the cam shaft 19 should preferably be greater than the width of the clearance between the cams 27*a* and 27*b*. In other words, the clearance between the cams 27*a* and 27*b* should preferably be as small as possible in order to maintain a minimum amount of movement of the rocker arm 19. The amount of movement of the rocker arm 19 is so limited that the knocker 25 threaded at the front portion of the rocker arm 19 cannot be disengaged from the valve lifter 17 when the rocker arm 19 is moved.

In an embodiment according to the present invention, the abutment between the rocker arm 19 and the cam 27*a* or 27*b* is selectively changed by means of the drive mechanism, such as the hydraulic cylinder 24 (FIG. 2) connected to the rocker arm slide shaft 23, when the engine rotating speed exceeds a predetermined value.

Various alterations of the above-described embodiment are possible. For example, the movable stoppers 35 and 37 illustrated in FIGS. 2 and 3 may be formed in one body (not shown) which has a radial hole for inserting the screw bolt 43.

Figure 4:
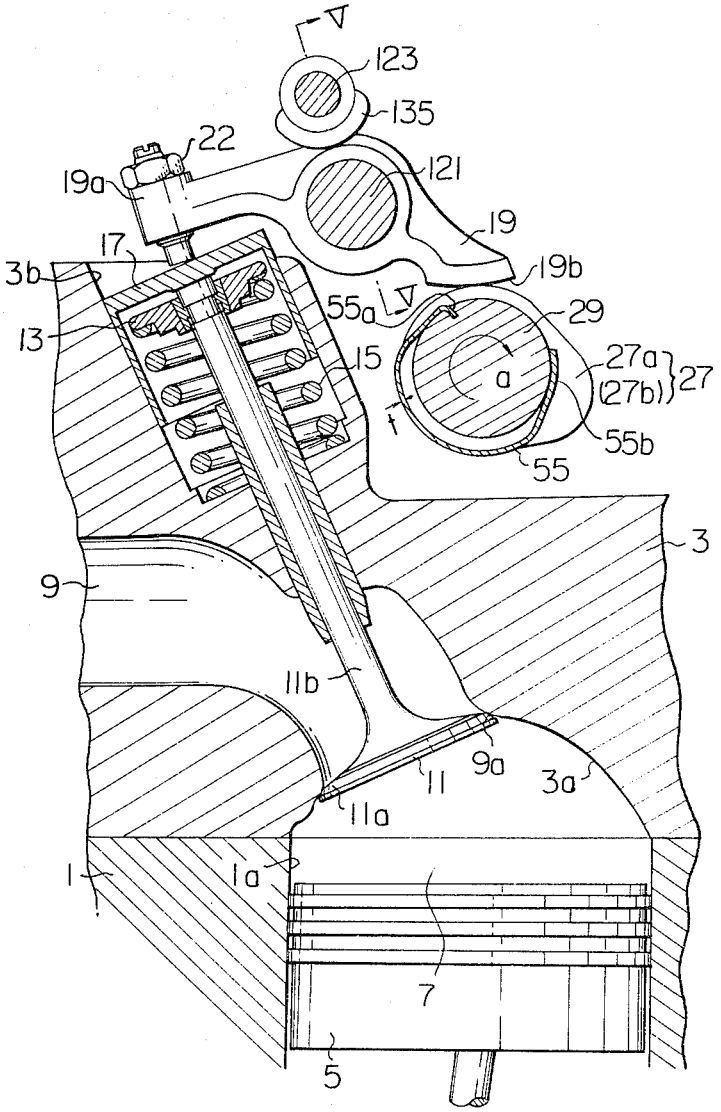
FIG. 4 is a cross-sectional elevational view of a second embodiment according to the present invention.
Figure 5:
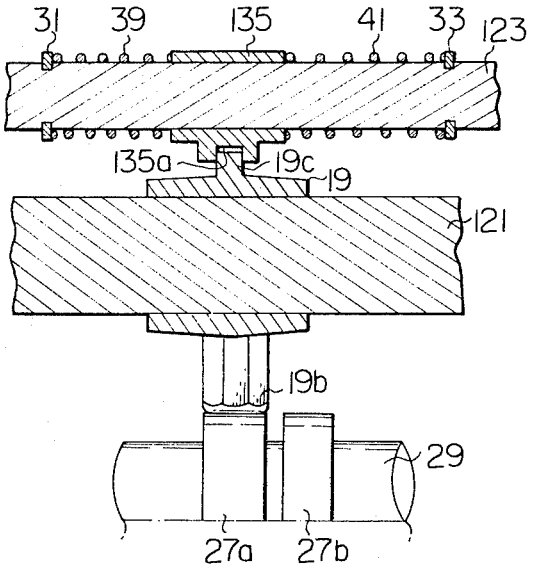
FIG. 5 is a cross-sectional view taken along the line V—V in FIG. 4.

In the above-mentioned altered embodiment, the rocker shaft 21 is formed in a hollow cylinder which has the rocker arm slide shaft 23 positioned thereon. However, in a second embodiment which will now be explained with reference to FIGS. 4 and 5, a rocker shaft 121 is formed in a solid cylinder and a rocker arm slide shaft 123 is disposed parallel to the rocker shaft 121. Because the reference numerals used for indicating the parts in the second embodiment are the same as those in the first embodiment, an explanation therefor is omitted from herein. The rocker arm 19 is carried on the rocker shaft 121 so that the rocker arm 19 can be swingable about and slidable along the rocker shaft 121. Referring to FIG. 5, the rocker arm slide shaft 123, which is disposed parallel to the rocker shaft 121, has two stationary stops 31 and 33 fixed on the rocker arm slide shaft 123, a movable stop 135 slidably inserted onto the rocker arm slide shaft 123, and compression springs 39 and 41 disposed between stops 31, 33 and 135. A groove 135*a* formed on the movable stop 135 engages with an annular projection 19*c* formed on the rocker arm 19. Between the rocker arm 19 and the rocker shaft 121 is disposed a spring urging mechanism (not shown) which is similar to that of the first embodiment and which comprises annular grooves, a ball and a spring for urging the ball.

Figure 6:
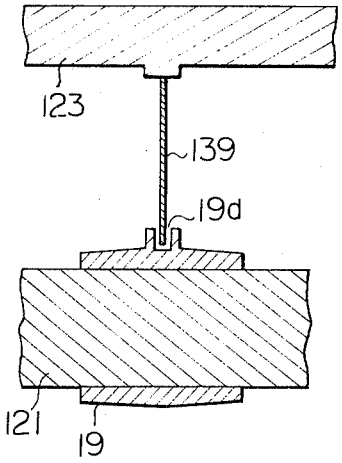
FIG. 6 is a cross-sectional elevational view of a third embodiment according to the present invention.

Referring to FIG. 6, a third embodiment of the present invention will now be explained. Instead of the connecting compression springs 39 and 41, which are used in the first and second embodiments for transmitting the movement of the rocker arm slide shaft 23 or 123 to the rocker arm 19, a plate spring 139 is used for a connecting spring in the third embodiment, one end of which spring is fixed to the rocker arm slide shaft 123 and the other end of which engages with a groove 19*d* formed on the rocker arm 19. Since the other construction of the third embodiment is similar to that of the second embodiment, further explanation therefor is accordingly not provided herein.

Figure 7:
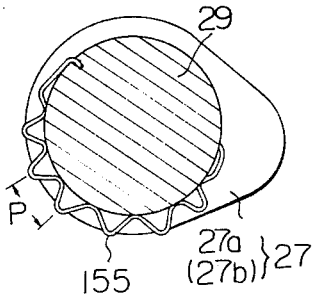
FIG. 7 is a cross-sectional elevational view of a modified stopper guide.

An alteration of the stopper guide of the present invention, which is disposed at a space between the cams, will now be explained with reference to FIG. 7. The stopper guide 55 illustrated in FIGS. 1 and 4 has an end fixed onto the camshaft 29, another end formed into a free end, and a circular-shaped arch which connects both ends. The stopper guide 155 illustrated in FIG. 7 is, however, made of a corrugated plate extending between its fixed end portion and its free end portion, the upper peripheries of which plate slightly projecting beyond the base circles of the cams 27*a* and 27*b* and the lower peripheries of which plate being in contact with the outer surface of the camshaft 29. The wave length P, i.e., a distance between the two adjacent upper peripheries, is so selected that the rocker arm pad 19*b* (FIGS. 1 and 4) can smoothly come into contact with the upper peripheries. Accordingly, this construction can improve the rigidity of the stopper guide 155 against a force acting on a side thereof.

What we claim is:

1. A variable valve event engine, comprising:

(a) a rocker shaft disposed along said engine;

(b) a rocker arm for actuating a valve of said engine, said rocker arm being pivotably and slidably disposed on said rocker shaft;

(c) a camshaft disposed parallel to said rocker shaft and synchronized to a crankshaft of said engine;

(d) a plurality of adjacent cams having cam profiles different from each other fixed on said camshaft so as to be adjacent to each other;

(e) a rocker arm slide shaft disposed parallel and longitudinally moveable with respect to said rocker shaft;

(f) spring force means interconnecting said rocker arm with said rocker arm slide shaft for storing energy and for longitudinally moving said rocker arm from one predetermined position to another predetermined position on said rocker shaft when said stored energy exceeds a predetermined force (g) overcomeable force means imposing said predetermined force for releasably securing said rocker arm in different predetermined positions longitudinally spaced on said rocker shaft in response to energy changes in said spring force means, each said position being aligned with one of said cams permitting said rocker arm to cooperate with said different cam profiles;

(h) power means for selectively storing energy in said spring force means to cause movement of said rocker arm from one of said cams to another.

2. The variable event engine as in claim 1, wherein said overcomeable force means comprises a ball disposed in a cylindrical opening in said rocker arm, said ball being adjustably biased toward said rocker shaft for engaging detents in said rocker shaft, said detents defining said predetermined positions.

3. The variable event engine as in either of claims 1 or 2 wherein said spring force means comprises a bias spring means secured to said rocker arm slide shaft, means for transmitting bias force of said bias spring means to said rocker arm, and means for interconnecting said power means to said rocker arm slide shaft for selectively increasing the bias force of said bias spring means transmitted to said rocker arm until said bias force exceeds the force of said overcomeable force means.

4. The variable event engine as in claim 3, wherein said rocker shaft is a hollow cylinder, wherein said rocker arm slide shaft is slidably disposed in said rocker shaft and includes a pair of spaced, fixed annular stops secured to and extending from the surface of said rocker arm slide shaft and a movable annular stop slidably disposed around said rocker arm slide shaft between said fixed annular stops, wherein said bias spring means includes two compression springs disposed around said rocker arm slide shaft, one being disposed between one fixed annular stop and said movable annular stop and the other being disposed between the other fixed annular stop and said movable annular stop, and wherein said bias force transmitting means is a member fixed to said rocker arm, extending through an elongated slot in said rocker shaft and engaging said movable annular stop, such that selective movement of said rocker arm slide shaft by said power means compresses one of said compression springs between its respective fixed annular stop and said movable stop thereby increasing the bias force of said one compression spring.

5. The variable event engine as in claim 3, wherein said rocker arm slide shaft is spaced from and parallel to said rocker shaft and includes a pair of spaced, fixed annular stops secured to and extending from the surface of said rocker arm slide shaft and a movable annular stop slidably disposed around said rocker arm slide shaft between said fixed annular stops, wherein said bias spring means includes two compression springs being disposed around said rocker arm slide shaft, one said compression spring being disposed between one said fixed annular stop and said movable annular stop and the other compression spring being disposed between the other fixed annular stop and said movable annular stop, and wherein said bias force transmitting means is a member fixed to and extending from said rocker arm and engaging said movable annular stop, such that selective movement of said rocker arm slide shaft by said power means compresses one of said compression springs between its respective fixed annular stop and said movable annular stop thereby increasing the bias force of said one compression spring.

6. The variable event engine as in claim 3, wherein said rocker arm slide shaft is spaced from and parallel to said rocker shaft and wherein said bias spring means and said bias force transmitting means is a spring fixed to and extending from said rocker arm slide shaft and engaging said rocker arm, such that selective movement of said rocker arm slide shaft by said power means bends said spring thereby increasing the bias force of said spring.

7. A variable valve event engine comprising:

a rocker shaft disposed along said engine;

a rocker arm for actuating a valve of said engine, said rocker arm being pivotally and slidably disposed on said rocker shaft;

a camshaft disposed parallel to said rocker shaft and synchronized with a crankshaft of said engine;

a plurality of adjacent cams having cam profiles different from each other fixed on said cam shaft so as to be adjacent to each other;

a rocker arm slide shaft disposed parallel and longitudinally movable with respect to said rocker shaft;

a spring connecting said rocker arm slide shaft with said rocker arm for transmitting movement of said rocker arm slide shaft to said rocker arm;

power means respective to engine parameters for longitudinally moving said rocker arm slide shaft and for biasing said spring to longitudinally move said rocker arm; and means responsive to a predetermined level of biasing force in said spring for releasably securing said rocker arm in predetermined positions longitudinally spaced on said rocker shaft, each said position being aligned with one of said cams permitting said rocker arm to cooperate with said different cam profiles, said securing means releasing said rocker arm for longitudinal movement on said rocker shaft from one said position to another said position when longitudinal movement of said rocker arm slide shaft increases the bias of said spring against the secured rocker arm above said predetermined level;

wherein by sliding said rocker arm along said rocker shaft, said valve is selectively actuated by means of one of said cams.

8. A variable valve event engine according to claim 7, wherein said rocker shaft is a solid cylinder and said rocker arm slide shaft extends outside of said solid cylinder.

9. The variable event engine as in claim 7, wherein said securing means is a ratchet mechanism being automatically released when said biasing force exceeds said predetermined level.

10. A variable valve event engine according to claim 7, wherein said rocker shaft is a hollow cylinder and said rocker arm slide shaft extends inside of said hollow cylinder.

11. A variable valve event engine according to claim 7, wherein said rocker shaft is a hollow cylinder, said rocker arm slide shaft extends inside of said hollow cylinder, and said connecting spring is disposed in said hollow cylinder between said rocker shaft and said rocker arm slide shaft so that said rocker arm is slid by means of energy retained in said spring.

12. A variable valve event engine according to claims 7, 10, 11, 1 or 2, which further comprises a guide disposed at a position between two adjacent cams and the trailing portion of the base circles of said cams with respect to the rotating direction of said cams so that said rocker arm can be prevented from moving while said rocker arm is not in contact with a position of said cam, which position being located at said base circles.

13. The variable event engine as in claim 12, wherein said valve includes a valve lifter having a flat surface for cooperating with said rocker arm.

* * * * *